US006170827B1

(12) United States Patent
Lombardo et al.

(10) Patent No.: US 6,170,827 B1
(45) Date of Patent: Jan. 9, 2001

(54) CARD GAME

(76) Inventors: Paul A Lombardo, 3162 Emerald Blvd., Long Pond, PA (US) 18334; Eric Brand, 1943 E. 19th St., Brooklyn, NY (US) 11229

( * ) Notice: Under 35 U.S.C. 154(b), the term of this patent shall be extended for 0 days.

(21) Appl. No.: 09/325,806

(22) Filed: Jun. 4, 1999

(51) Int. Cl.[7] ..... A63F 1/00

(52) U.S. Cl. ..... 273/292; 273/274; 273/303; 463/12; 463/13

(58) Field of Search ..... 273/292, 274, 273/303; 463/12, 13

(56) References Cited

U.S. PATENT DOCUMENTS 5,294,128 * 3/1994 Marquez .
5,660,393 * 8/1997 Dreger .
5,697,614 * 12/1997 Potter .
5,718,430 * 2/1998 Arampakul .
5,813,673 * 9/1998 Richardson .
5,863,042 * 1/1999 Lo .

* cited by examiner

*Primary Examiner*—Jeanette Chapman
*Assistant Examiner*—Vishu Mendiratta
(74) *Attorney, Agent, or Firm*—Michael I Kroll

(57) ABSTRACT

A card game to be played by preferably seven players completing individually against a dealer. The card game is generally patterned after conventional gambling games such as poker, but includes novel features practiced as steps of a method of play. One feature is that of having each player arbitrarily divide his or her initially dealt cards into two groups each of which is independently pitted against the dealer in two separate comparisons. Two stakes are thus established, one corresponding to each comparison. A second novel feature is that of being allowed to recombine cards to establish a new competitive position if the first comparison with the dealer results in a draw. A third novel feature is that the recombination can utilize a card from the dealer's holding. To play the novel game, the dealer is dealt four cards whereas the players are each dealt but three. The dealer's card holding which participates in the first comparison is predetermined, whereas for the players, this holding is selected at the player's discretion.

3 Claims, 6 Drawing Sheets

CARD GAME

BACKGROUND OF THE INVENTION

1. Field of the Invention

The present invention relates generally to card games and, more specifically, to a gaming card game using one or more standard decks of playing cards involving a dealer and up to seven players wherein each player is playing his or her hand against the dealer's hand. The principal application of the invention is commercial casinos, which entice the gaming public with a variety of card and other gambling games. However, the invention may also be practiced in other settings, wherein amusement is derived from a gambling game employing playing cards. Private gatherings, social clubs, and other recreational endeavors drawing numbers of gambling devotees together can employ the present invention.

2. Description of the Prior Art

There are numerous card games involving one or more decks of playing cards and incorporating gaming or gambling with tokens. These card games may be suitable for the purposes for which they where designed, but have lost a certain measure of allure to the gaming public due to excessive long standing familiarity. It is thus desirable to provide a new and novel card game wherein a number of players each pit their hands against a dealer's hand.

Games such as blackjack, poker, and others pit a dealer against a plurality of other players. The value of the player's hands, taken individually, is pitted against that of the dealer's hand. This may be accomplished by simple arithmetic addition, or by arbitrarily awarding superior status to certain cards or to certain combinations thereof.

However, all prior art games known to the applicants fail to offer an automatic opportunity on every deal to split a card holding into two independently pursued holdings, as occurs in the present invention.

SUMMARY OF THE PRESENT INVENTION

The present invention relates generally to card games and, more specifically, to a gaming card game using one or more standard decks of playing cards. The participants include a dealer and up to seven players, wherein each player is playing his or her hand against the dealer's hand. In the play, the players pit the game value of their cards against the game value of the dealer's cards. Each player is given an opportunity to divide his dealt holding into two new holdings. Each of the resulting new holdings are pitted independently against corresponding holdings of the dealer. Alternatively, the player can attempt to gain the stake by playing fewer than the number of dealt cards, with some cards being withdrawn from play.

It is further desirable to provide variations of the aforementioned card game by varying the value of the cards, by varying the number of wagering steps in a hand and value of tokens wagered, and by allowing a player to split one hand into two hands based on the value of his two card hand. In addition, combinations of players' cards can be made, in certain situations, by combining cards from the dealer with his or her own original cards. The option to divide the holding and to pursue a stake with fewer than the originally dealt cards, and the option to utilize another's cards mark significant differences between prior art card games and the novel game.

It is therefore an object of the present invention to provide a card game suitable for gaming which is new to the gaming public.

Another object of the present invention is to provide a new and novel card game using one or more decks of playing cards and a plurality of tokens.

Yet another object of the present invention is to provide a new and novel card game using one or more decks of playing cards and a plurality of tokens wherein a player has an opportunity to win back his or her ante without continuing to play the full deal.

Still yet another object of the present invention is to provide a new and novel card game wherein players can better their hands based on cards held in another hand.

Another object of the present invention is to provide a new and novel card game wherein players can increase the number of cards in their hands after dealing has been terminated.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE PREFERRED EMBODIMENTS

The present invention sets forth a card game in which a plurality of players individually pit their hands against that of a dealer. All prospective players who wish to partake in a hand place one or more tokens into a designated area in front of themselves, as an ante, thereby signalling to the dealer that they wish to play a hand. The cards are dealt out by the dealer one at a time to both players and the dealer. The cards are laid face down in front of each player and the dealer until each participant has three cards face down. The dealer then finished the dealing by placing first a single card face down, this being designated the Player's "sting" card, for each of the non-players in this seven player card game, and secondly a final card. The final card will hereinafter be referred to as the dealer's "sting" card, and is placed face down in a predetermined location between the dealer and the players.

Figure 1:
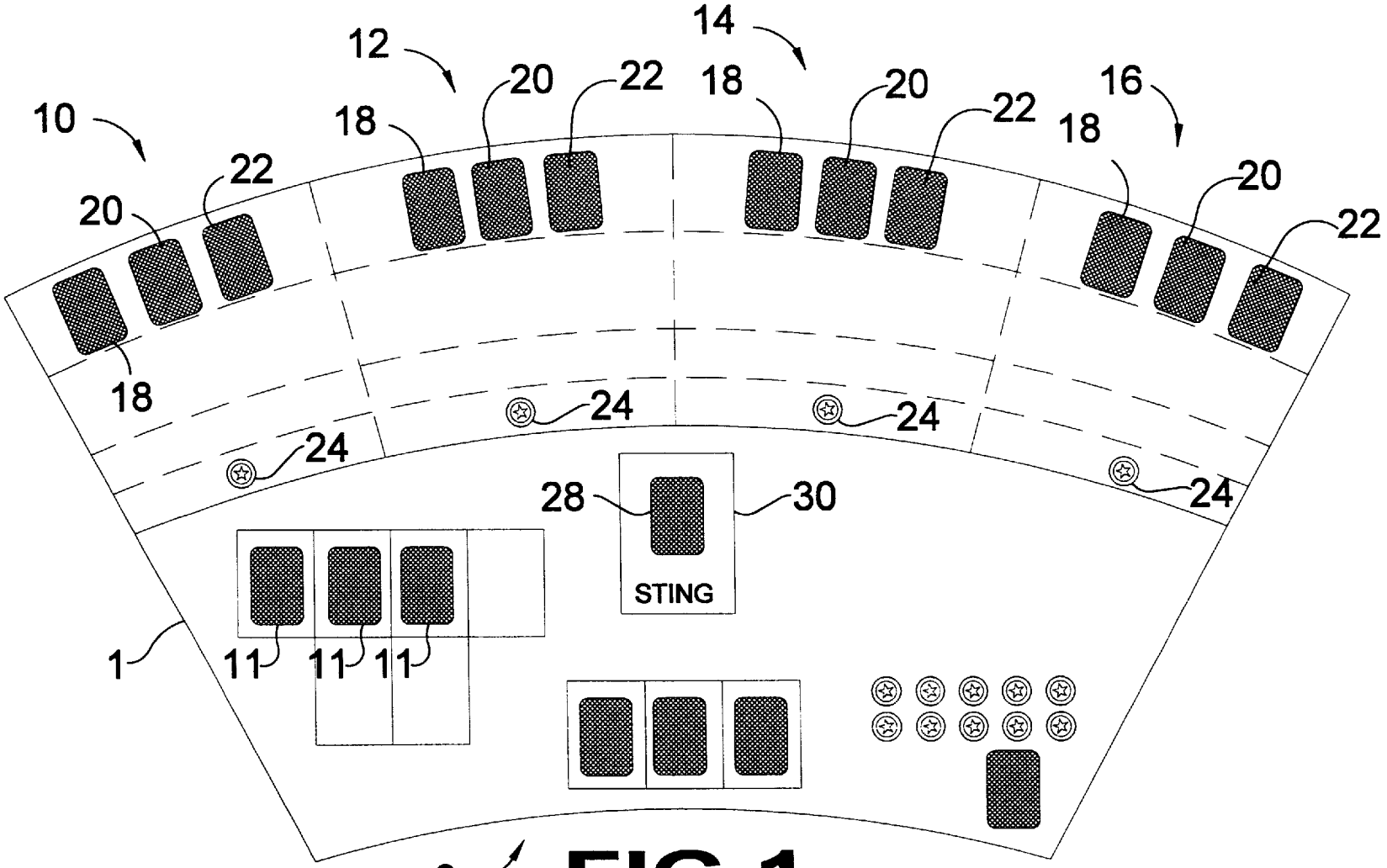
FIG. 1 is an illustration of a representative hand or deal after dealing and prior to play, to be played according to the game of the present invention.

FIG. 1 illustrates the initial position in a representative deal. Cards have been dealt to players at playing positions 10, 12, 14, 16 on a playing surface 1, such as a table bearing indicia demarcating areas devoted to placement of cards and of tokens for wagering. The dealer (indicated as position 2) has dealt three cards 18, 20, 22 to each participant who has put up an ante. The ante is in the form of a token 24. In the illustrated deal, since there are fewer than seven players, an additional players "sting" card 11 was set aside to complete the seven player field. In addition the dealer has placed an additional card, that being the dealer's "sting" card 28 in the predetermined location, which is sting box 30.

Figure 2:
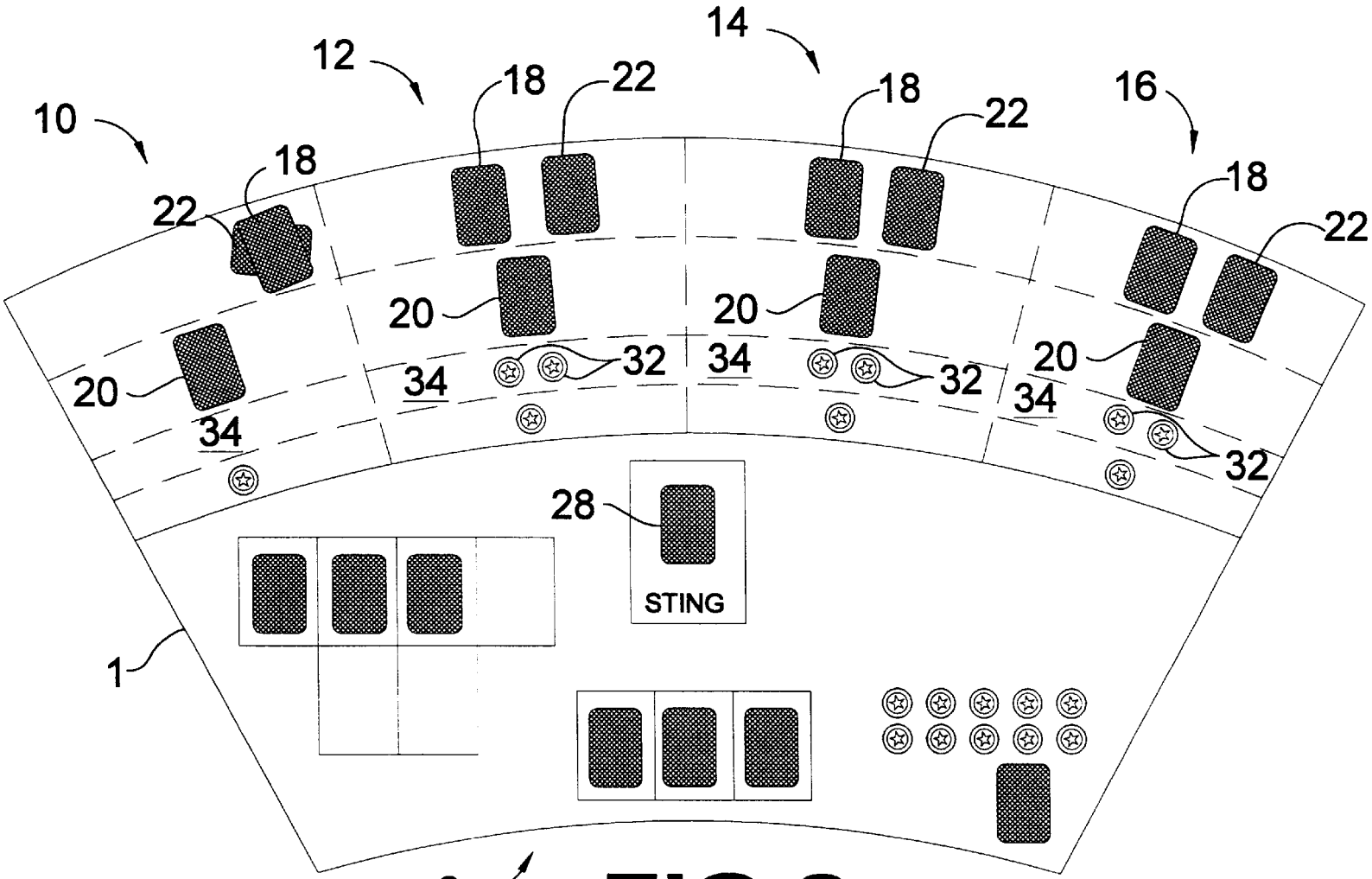
FIG. 2 is an illustration of a subsequent step in the play of the hand displayed in FIG. 1.

Each player picks up and assesses his or her three cards 18, 20, 22 and selects one of the three cards 18, 20, 22 as his or her sting card and places the selected sting card face down in front of him or herself. This is shown in FIG. 2, wherein the selected card for all active players (occupying positions 10, 12, 14, 16) is arbitrarily designated sting card 20. In addition, each player decides whether he or she will play the remaining two cards 18, 22 against the dealer's two card hand. The player signals the dealer of his or her decision by either surrendering the two cards, which option risks forfeiting the ante, or alternatively by placing one or more tokens 32 into the player's designated wagering area 34 as an additional wager based on the remaining two cards 18, 22. The remaining two cards 18, 22 are to be played as a hand independently of card 20, and will be pitted against the dealer's two card hand. Thus each player can potentially undertake two separate wagers arising from the one deal, or if preferred, proceed with only one wager.

In the illustrated example, the player at position 10 has surrendered the option to bet on cards 18, 22, instead choosing to proceed only with sting card 20. The stake corresponding to sting card 20 is token 24. It will be seen that no other tokens are placed on betting area of position 10.

Figure 3:
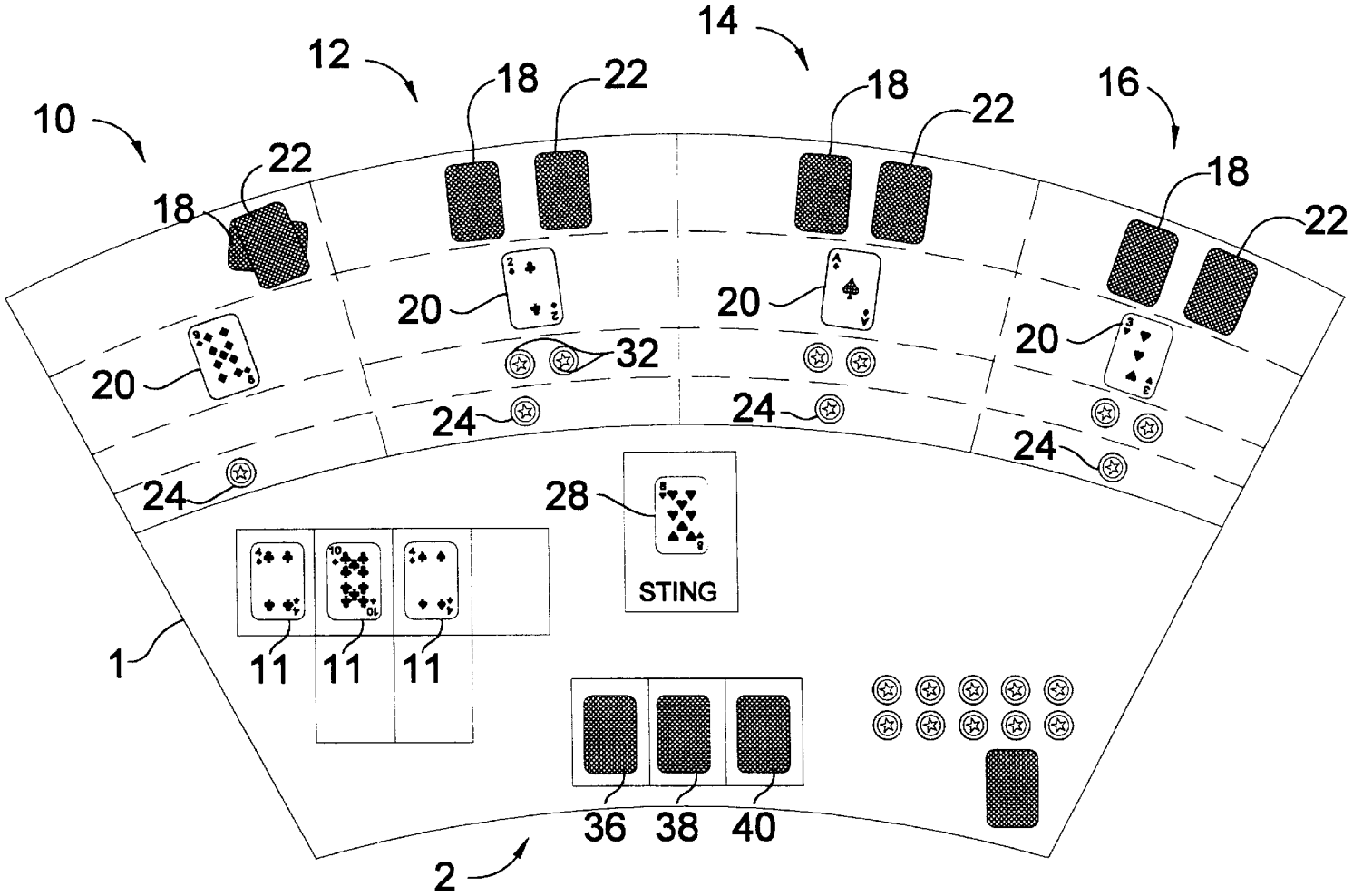
FIG. 3 is an illustration of the continuation of the hand displayed in FIG. 2.

As seen in FIG. 3, the dealer then turns the dealer's "sting" card 28 face up and, in turn, each of the seven players' "sting" cards 11 or 20. Should any of the players "sting" cards 11 or 20 be of equal value to the dealer's "sting" card 28, the dealer pays one or more tokens to said player whether or not he or she surrendered the hand which includes cards 18, 22. In summary, active players have the option to invest the entire future of the deal selectively in a single comparison by employing his or her sting card 20, or in a combination of two comparisons, one being sting card 20 and the other being the remaining two cards 18, 22.

In the illustrated example, none of the non-players' or players' "sting" cards 11 or 20 is of equal value to the dealer's "sting" card 28.

Figure 4:
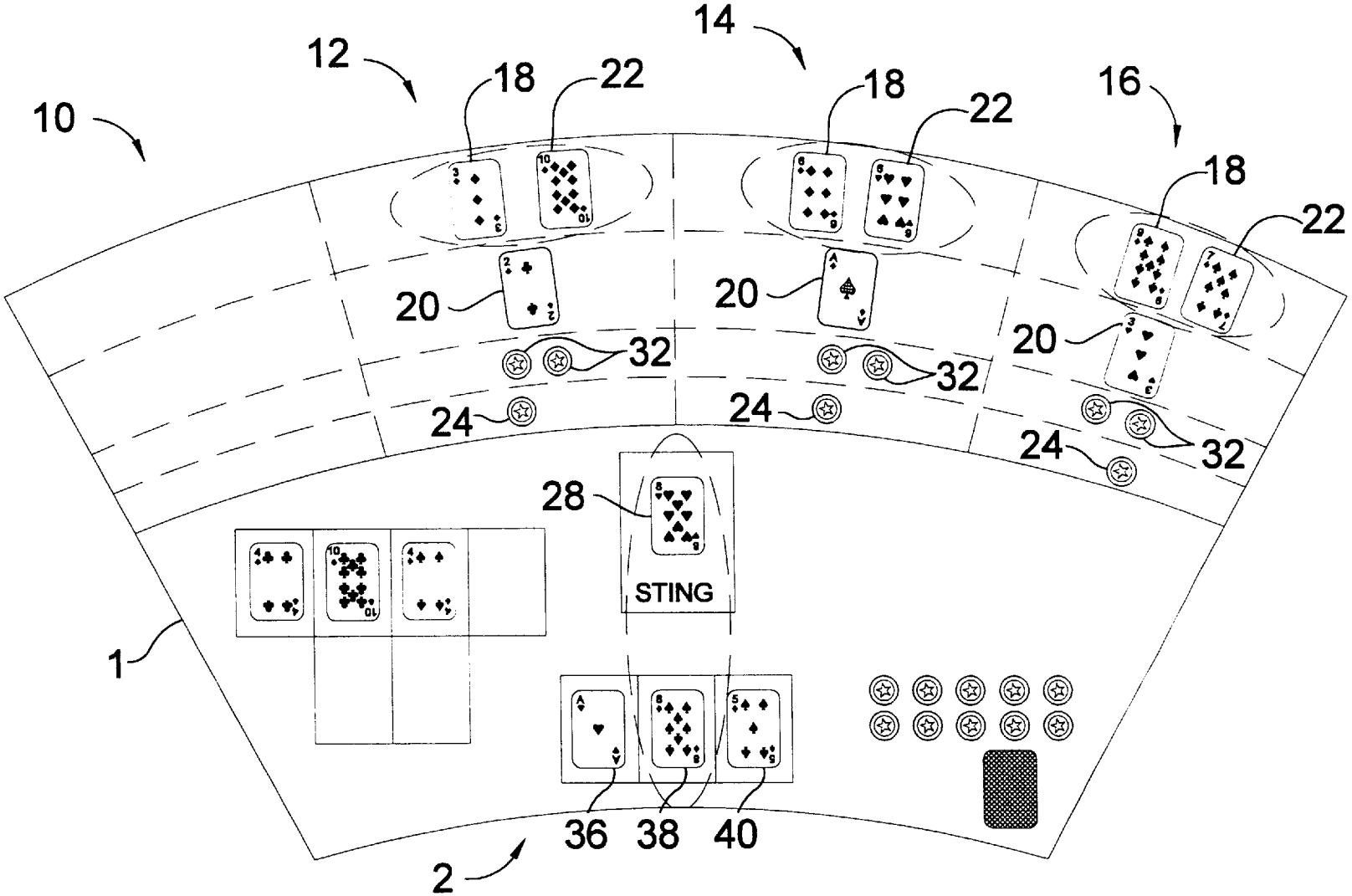
FIG. 4 is an illustration of the continuation of the hand displayed in FIG. 3.

Turning now at FIG. 4, the dealer combines the three card dealer's hand including cards 36, 38, 40 and the dealer's sting card 28 to create the best possible two card hand. The resulting two card hand, which comprises cards 28, 38, is then pitted against the hands comprising cards 18, 22 of the players. In addition, any players having surrendered their two card hand 18, 22 and not having matched the dealer's sting card with their player's "sting" card 20 forfeits their ante (token 24). This condition characterizes the player at position 10, and cards 18, 20, 22 and token 24 of position 10 are accordingly deleted from the view of FIG. 4. The hand then continues for all seven players with the exception of the non-players and those players who surrendered their two card hand 18, 22 and their ante (token 24) if no players "sting" card 20 matches the value of the dealer's "sting" card.

The dealer exposes the dealer's three cards 36, 38, 40 and including the dealer's "sting" card 28 must have at least a queen high for the dealer to continue playing. The players expose their two card hands 18, 22 which are compared to the dealer's best two card hand (cards 28, 38) out of the four cards 28, 36, 38, 40. The dealer's two card hand 18, 38 is compared to each player's two card hand 18, 22 in turn. When the dealer's hand is higher than any given player's hand, the player forfeits his or her ante (token 24) and the bet (tokens 32). This comparison is continued for all player's and completes the hand.

Play continues for the remaining players by comparing the value of their hands against the value of the dealer's hand in the following manner. Should any of the players "sting" card 20 be of equal value to the dealer's "sting" card 28 then each and every player can selectively create a new two card hand optionally combining the value of the dealer's "sting" card 28 to better his or her hand. In addition, the player or players matching the value of the dealer's sting card 28 are allowed to create the best four card hand using their original two card hand 18, 22, their respective "sting" card 29 and the dealer's "sting" card 28.

In none of the seven player's "sting" cards 20 is of equal value to the dealer's "sting" card 28 then the dealer can selectively use the dealer's "sting" card 28 to better the dealer's two card hand.

The hand is concluded when the dealer claims all tokens 24, 32 in front of each player having a hand of less value than the dealer's hand or by paying a player or players a predetermined amount of tokens based on whether that player's hand is of equal or greater value than the dealer's hand.

Figure 5:
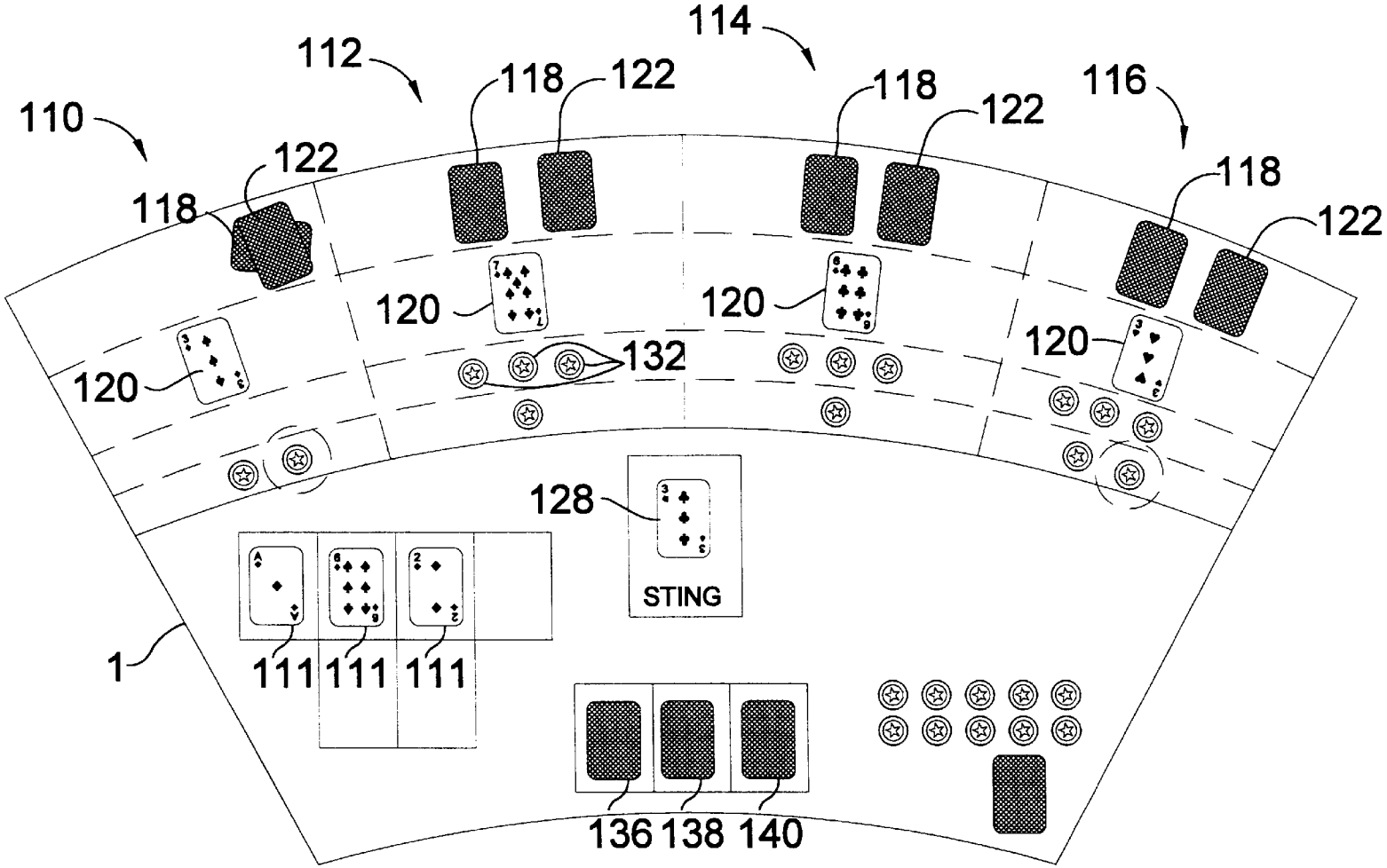
FIG. 5 is an illustration of a different representative hand or deal to be played according to the game of the present invention, shown with play partially underway.

Turning now to FIG. 5, the dealer has displayed the dealer's "sting" card 128, the non-players "sting" cards 111 and the player's "sting" cards 120. Two of the four player's "sting" cards 120 (these being players at positions 110 and 116) match the dealer's "sting" card 128. The dealer pays out one or more tokens, matching the original ante, to each of these players. The player or players having matched the dealer's "sting" card retrieve their winnings and the hand continues without those players having previously chosen not to play their two card hand.

The dealer turns over the dealer's three cards 136, 138, 140 and must have a Queen or better to continue playing. The players turn over their two card hands (cards 118, 122) and create the best three card hand combining the values of their original two cards 118, 122 and the dealer's sting card 128. This procedure is not followed by the player's having matched the dealer's "sting" card 128. This player or players create the best four card hand using the original two card hand (cards 118, 122), their "sting" card 120, and the dealer's "sting" card 128. The dealer is only allowed to build the best two card hand out of the dealer's three cards 136, 138, 140.

Figure 6:
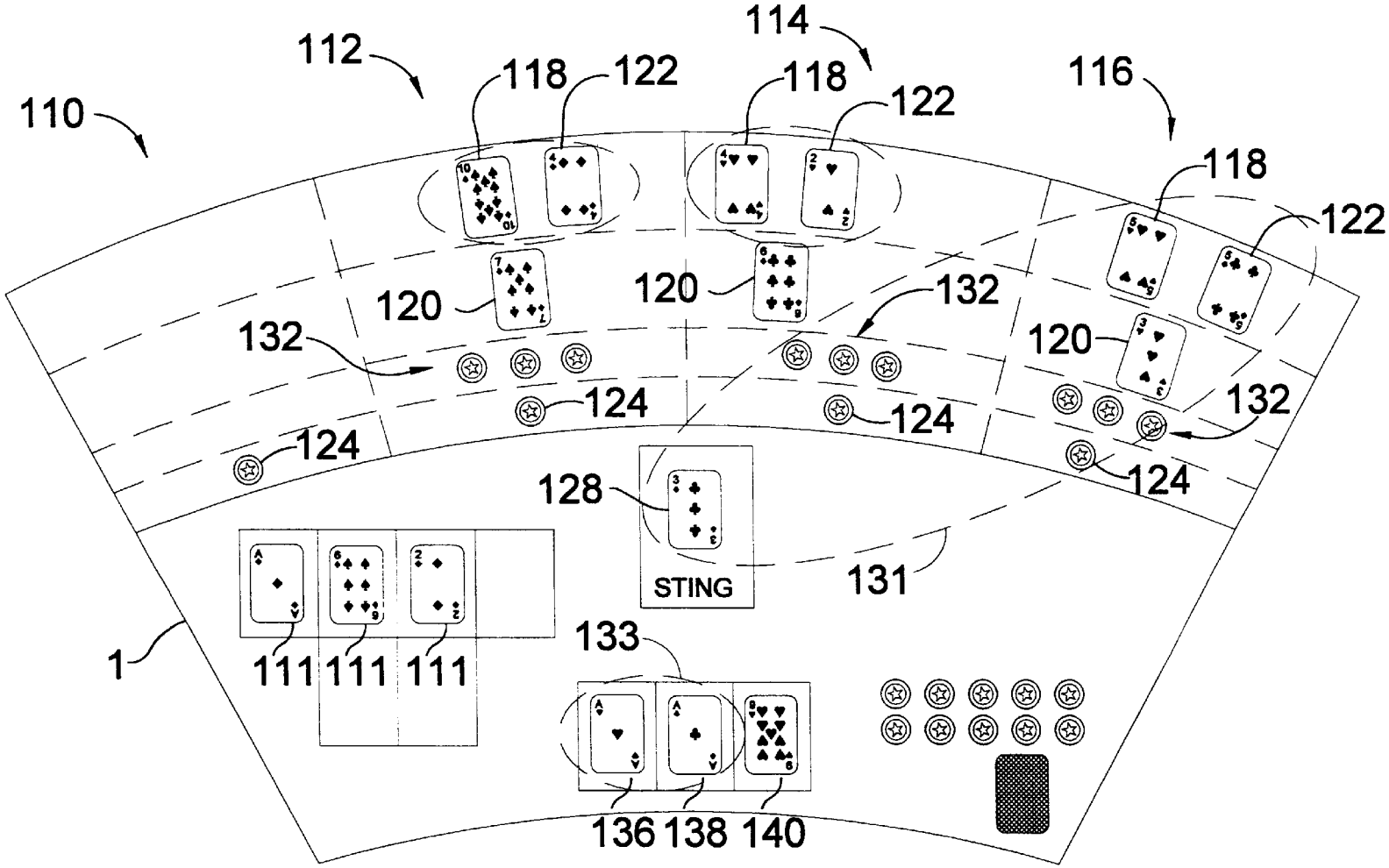
FIG. 6 is an illustration of the combination of the hand displayed in FIG. 5.

FIG. 6 is an illustration of the continuation of the hand displayed in FIG. 5. The dealer exposes the dealer's three cards 136, 138, 140, which must have a queen or high or better for the dealer to continue playing. The players expose their two card hands derived from the originally chosen two cards 118, 122 plus the sting card 120. The player or players whose sting card 120 has matched the sting card 128 of the dealer then designate the best four card hand, drawing from the original two cards 118, 122, their "sting" cards 120, and the dealer's "sting" card 128. The player at position 116 enjoys this option, the four cards being indicated by broken line 131.

The dealer's two card hand (cards 136 and 138, in the depiction of FIG. 6) is compared to each player's hand in turn. This comparison is made in the case of players at positions 112 and 114. When the dealer's hand is higher than the player's hand, the player forfeits the ante (token 124) and the bet (tokens 132). If the novel game is based on the rules of poker, then the dealer's combination of cards 136 and 138 (indicated by broken line 133) defeats the holding of the players at positions 112 and 114. This comparison is continued for all player's and completes the hand. If one or more player's hands is greater than the dealer's hand then the dealer pays out one or more tokens based on a predetermined payment schedule based on the value of the player's hand.

Valuation of cards for the purpose of determining the high card may be based on any preselected criterion. Illustratively, it may be based on those of poker. In such a case, a two card combination of any pair would be rated higher than a two cards of different rank, even if the numerical value of the dissimilar two cards exceeded the numerical value of the pair. Alternatively, the valuation may be based on numerical total or any other preselected characteristics possible with playing cards. Hence the final game can, in limited aspects, simulate poker or any other known card game.

In summary, the significant steps of the game may be stated in general terms as dealing a predetermined number of cards to the dealer and to the players, having each player establish a first stake (token 24 or 124), and designating a first portion of dealt cards of each player as corresponding to the first stake. The first portion of dealt cards corresponds to sting card 20 or 120. Each player then elects to designate his or her remaining dealt cards (18, 22 or 118, 122) of each player selectively as corresponding to a second stake (tokens 32 or 132) and alternatively to withdraw the remaining dealt cards from active play. Cards 18, 22 and 118, 122 of position 10 illustrate cards withdrawn from active play.

Pitting sting cards 20 or 120 against sting cards 28 or 128 of the dealer is to be regarded as making a first comparison in which the first portion of cards dealt to a player are compared to a corresponding number of cards held by the dealer. A first winning card combination is determined from the comparison, even if the combination requires only one card. In alternative embodiments of the invention (not described herein), the first comparison could conceivably pit plural cards of the players against plural cards of the dealer. The first comparison results in awarding the first stake selectively to a player and to the dealer according to whichever of the player and the dealer holds the first winning card combination.

The step of segregating cards 18, 22 (or 118, 122) from card 20 (or card 120), and placing a wager in the form of tokens 32 or 132 may be generalized as practicing steps of establishing a second stake. When sting cards 20 or 120 are compared to sting card 28 or 128 of the dealer, the comparison determines whether a match occurs as a result of the first comparison. If a match occurs, as was described with reference to FIG. 5, then the player having a matching sting card 120 is allowed to recombine his or her dealt cards together with at least one dealt card of the dealer to define a new card holding.

A third comparison is made between the recombined dealt cards of the player and a corresponding number of cards dealt to the dealer. This is described in FIG. 6. The third comparison determines a second winning card combination as a result thereof. The second stake is awarded to the holder of the second winning card combination.

It should be noted that the step of dealing a predetermined number of cards to the dealer and to the players comprises the further step of dealing a first predetermined number of cards to at least one player, and a different and lesser predetermined number of cards to at least one other player. This is the case wherein players at positions 10, 12, 14, 16, (or 110, 112, 114, 116) have the first predetermined number of cards, and the non-players holding a single card 11 (or 111) have a lesser predetermined number of cards.

It should further be noted that a first predetermined number of cards 136, 138, 140 is dealt to the dealer, while a different and lesser second predetermined number of cards 18, 20, 22 (or 118, 120, 122) is dealt to each player. The dealer is allowed to select among the greater predetermined number of cards to establish a dealer's hand to be compared to hands of the players, whereas each player is limited to select from the lesser second predetermined number of cards to establish a player's hand to be compared to the hand of the dealer.

In this case, the step of determining a first winning card combination is based on comparing the dealer's hand established by allowing the dealer to select among the greater predetermined number of cards with each player's hand established by limiting each player to select from the lesser second predetermined number of cards.

It is to be understood that the present invention is not limited to the embodiments described above, but encompasses any and all embodiments within the scope of the following claims.

We claim:

1. A method of playing a wagering game played between a dealer and a plurality of players competing with the dealer, wherein the game employs playing cards and a playing surface, the method of play comprising the steps of dealing a first predetermined number of cards to the dealer, a second lesser predetermined number of cards to the players, and a third still lesser predetermined number of cards to non-players;

establishing a first stake;

allowing the dealer to select among the greater predetermined number of cards to establish a dealer's hand to be compared to hands of the players;

limiting each player to select from the lesser second predetermined number of cards to establish a player's hand to be compared to the hand of the dealer;

designating a first portion of dealt cards of each player as corresponding to the first stake;

electing to designate remaining dealt cards of each player selectively as corresponding to a second stake and alternatively to withdraw the remaining dealt cards from active play;

making a first comparison in which the first portion of cards dealt to a player are compared to a corresponding number of cards held by the dealer, and determining the first winning card combination from the comparison wherein said step of determining a first winning card combination is based on comparing the dealer's hand established in said step of allowing the dealer to select among the greater predetermined number of cards with each player's hand established in said step of limiting each player to select from the lesser second predetermined number of cards; and awarding the first stake selectively to a player and to the dealer according to whichever of the player and the dealer holds the first winning card combination.

2. The method of playing a wagering game according to claim 1, wherein said step of dealing a predetermined number of cards to the dealer comprises the further step of dealing four cards to the dealer, and said step of dealing a different and lesser second predetermined number of cards to each player comprises the further step of dealing three cards to each player.

3. A method of playing a wagering game played between a dealer and a plurality of players competing with the dealer, wherein the game employs playing cards and a playing surface, the method of play comprising the steps of dealing three cards to each player and four cards to the dealer;

establishing a first stake and a second stake;

designating a single first dealt card of each player as corresponding to the first stake;

electing to designate the two remaining dealt cards of each player selectively as corresponding to the second stake and alternatively to withdraw the two remaining dealt cards from active play;

making a first comparison in which the designated single first card dealt to a player is compared to a corresponding card held by the dealer, and determining either a first winning card combination from the first comparison, or whether a match occurs as a result of the first comparison;

awarding the first stake selectively to a player and to the dealer according to whichever of the player and the dealer holds the first winning card combination from the first comparison;

allowing a player to recombine dealt cards of that player together with at least one dealt card of the dealer to define a new card holding if a match has resulted from the first comparison;

making another comparison between the recombined dealt cards of a player and a corresponding number of cards dealt to the dealer;

determining a second winning card combination as a result of the other comparison; and awarding the second stake to the holder of the second winning card combination, wherein the dealer is allowed to select among the greater predetermined number of cards to establish a dealer's hand to be compared to hands of the players, and each player is limited to select from the three cards to establish a player's hand to be compared to the hand of the dealer, wherein said step of determining a second winning card combination is based on comparing the dealer's hand established in said step of allowing the dealer to select among the four cards with each player's hand established in said step of limiting each player to select from the lesser second predetermined number of cards.

* * * * *